United States Patent [19]

Lange

[11] 3,961,478

[45] June 8, 1976

[54] INSTALLATION FOR THE CATALYTIC AFTERBURNING OF EXHAUST GASES IN THE EXHAUST GAS SYSTEM OF AN INTERNAL COMBUSTION ENGINE

[75] Inventor: Karlheinz Lange, Stuttgart, Germany

[73] Assignee: Dr. -Ing. H.c.F. Porsche Aktiengesellschaft, Germany

[22] Filed: Dec. 6, 1974

[21] Appl. No.: 530,298

[30] Foreign Application Priority Data

Dec. 5, 1973 Germany ..... 2360581

[52] U.S. Cl. ..... 60/277; 23/288 FA; 60/288

[51] Int. Cl.[2] ..... F02B 75/10

[58] Field of Search ..... 60/277, 288; 123/198 D, 123/198 DB; 23/288 FA

[56] References Cited

UNITED STATES PATENTS

| | | | |
|---|---|---|---|
| 3,440,817 | 4/1969 | Saufferer | 60/288 |
| 3,817,031 | 6/1974 | Goto | 60/288 |
| 3,837,165 | 9/1974 | Arrigoni | 60/288 |

*Primary Examiner*—Douglas Hart
*Attorney, Agent, or Firm*—Craig & Antonelli

[57] ABSTRACT

An installation for the catalytic afterburning of exhaust gases in the exhaust gas system of an internal combustion engine, which is equipped with a by-pass line by-passing the installation for the catalytic afterburning, whereby a throttle valve actuated in dependence on the temperature of the installation for the catalytic afterburning is arranged in the by-pass line; to prevent the throttle valve from getting stuck due to rusting, the throttle valve is actuated also independently of the temperature of the installation for the catalytic afterburning, in dependence on at least one parameter of the internal combustion engine.

6 Claims, 1 Drawing Figure

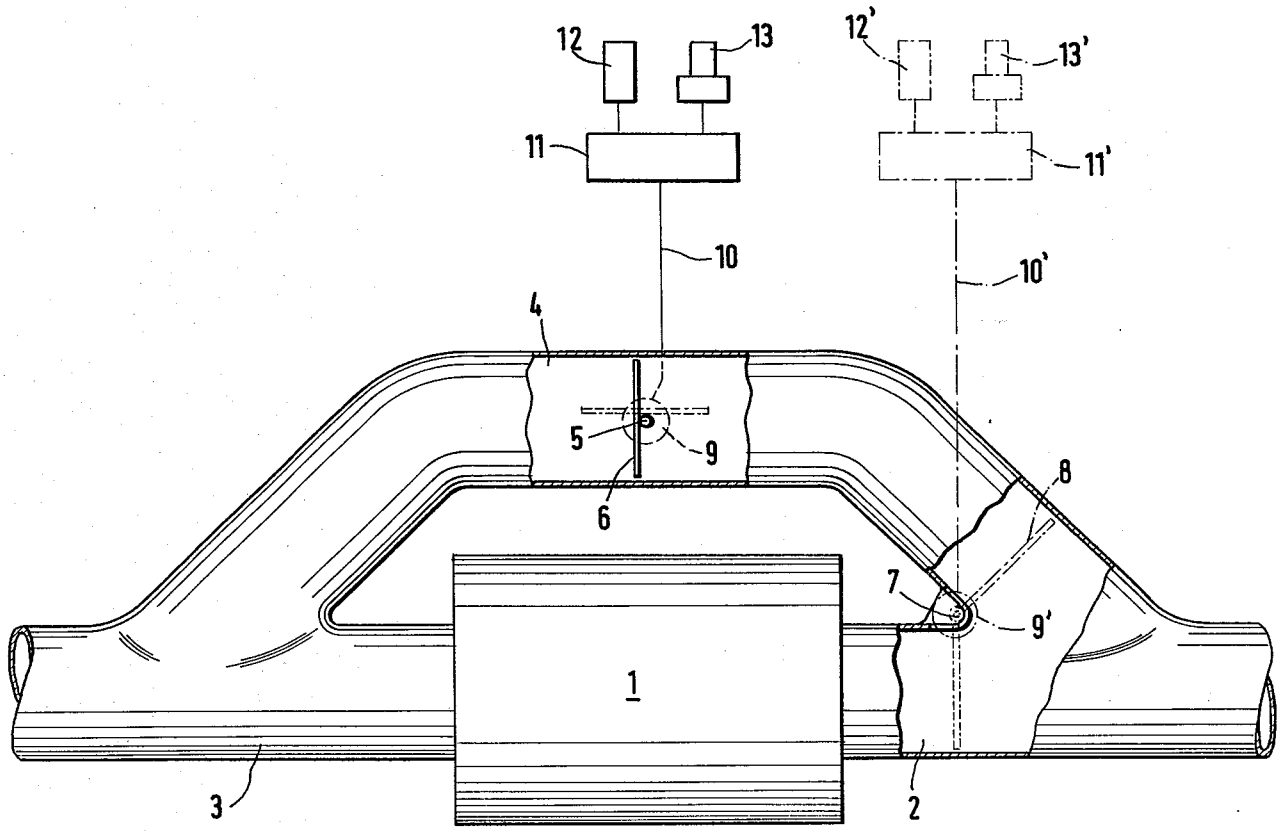
1
2
3
4
5
6
7
8
9
9'
10
10'
11
11'
12
12'
13
13'

INSTALLATION FOR THE CATALYTIC AFTERBURNING OF EXHAUST GASES IN THE EXHAUST GAS SYSTEM OF AN INTERNAL COMBUSTION ENGINE

The present invention relates to an installation for the catalytic afterburning of exhaust gases in the exhaust gas system of an internal combustion engine, with a by-pass line by-passing the installation for the catalytic afterburning, in which is arranged a throttle valve actuated in dependence of the temperature of the installation for the catalytic afterburning.

With installations for the catalytic afterburning of exhaust gases of the aforementioned type, the throttle valve is arranged in the by-pass line in order to close the by-pass line when the catalyst is in normal operating ranges and in order to open the by-pass line when the catalyst is in incompatible or intolerable operating ranges. This control takes place in dependence on the temperature of the catalyst. However, it has been found in connection therewith to be particularly disadvantageous that the throttle valve, in case of a longer non-actuation, itself may be no longer actuatable, for example, as a result of getting stuck due to corrosion and rusting. This has a consequence that the catalyst continues to be acted upon by exhaust gases within non-compatible operating ranges whereby a damaging of the catalyst is unavoidable.

It is the aim of the present invention to provide an installation for the catalytic afterburning of exhaust gases in the exhaust gas system of an internal combustion engine which does not exhibit the aforementioned disadvantage.

The underlying problems are solved according to the present invention in that the throttle valve is actuated also independently of the temperature of the installation for the catalytic afterburning, in dependence on at least one parameter of the internal combustion engine. It is of advantage that the throttle valve, after the ignition of the internal combustion engine is turned off, is actuated by the oil pressure in the internal combustion engine which continues to be present for a short period of time, by way of an oil pressure switch and a control installation. It is favorable that the throttle valve is being formed by a throttle valve opening and closing only the by-pass line or that the throttle valve is being formed by a throttle valve alternately opening and closing the by-pass line and the inlet channel to the installation for the catalytic afterburning of the exhaust gases.

The advantages achieved by the present invention reside in particular in that a rusting fast, i.e., a getting stuck due to corrosion, or the like, on the part of the throttle valve is reliably avoided by the installation according to the present invention without requiring an additional activity over and above the operating functions already necessary anyhow on the part of the vehicle driver. The damaging of the installation for the catalytic afterburning of the exhaust gases by excessively high operating temperatures as a result of non-functioning throttle valves and therewith as a result of a closed by-pass line is reliably avoided by the present invention.

These and further objects, features and advantages of the present invention will become more apparent from the following description when taken in connection with the accompanying drawing which shows, for purposes of illustration only, two embodiments in accordance with the present invention, and wherein:

The single FIGURE is a schematic view illustrating two possible embodiments in accordance with the present invention.

Referring now to the single FIGURE of the drawing, reference numeral 1 designates therein the installation for the catalytic afterburning of the exhaust gases which is of conventional construction and which includes an inlet channel 2 and an exhaust channel 3 for the exhaust gases. The inlet channel 2 and the exhaust channel 3 are connected by way of a by-pass line designated by reference numeral 4 and by-passing the installation 1. Either the throttle valve 6 rigidly connected with the shaft 5 or the throttle valve 8 rigidly connected with the shaft 7 is pivotally arranged in the by-pass line 4. The throttle valve 6 and 8 is actuated by an adjusting motor 9 and 9', respectively, of any conventional construction which is connected by an electric line 10 and 10' with an electric or electronic control installation 11 and 11' of conventional construction. The control device 11 and 11' is influenced by a conventional temperature sensor 12 and 12', respectively, determining the temperature of the installation 1 and by an oil pressure switch 13 and 13' of the internal combustion engine (not shown). The throttle valve 8 and the parts necessary for its control are indicated in the drawing in dash and dot lines, it being understood that only one of the valve control systems 5, 6, 9, 10, 11, 12, 13 and 7, 8, 9', 10', 11', 12' and 13' will be used in a given installation.

OPERATION

The operation of the throttle valve 6 is as follows:

When starting the internal combustion engine (not shown), the exhaust gases with a closed throttle valve 6 are conducted through the inlet channel 2 of the installation 1 and are exhausted into the atmosphere through the exhaust channel 3. If the temperature of the installation 1 (catalyst with a monolith or bulk material) increases in such a manner that the installation 1 approaches incompatible, intolerable operating ranges, then the adjusting motor 9 is actuated by way of the temperature-sensor 12 arranged within the area of the installation 1, the control device 11 and the electric line 10, whereby the adjusting motor 9 pivots the throttle valve 6 into the position illustrated in dash and dot lines. The exhaust gases are now exhausted into the atmosphere essentially through the by-pass line 4 so that the temperature of the installation 1 is no longer increased significantly. For purposes of avoiding, for example, a getting stuck of the throttle valve 6 due to corrosion or rusting during longer non-actuation thereof, the oil pressure switch 13 is provided which is of a commercially available conventional type. The oil pressure switch 13 effects, after the turning off of the ignition of the internal combustion engine and controlled by the electric control device 11 by way of the electric line 10 and the adjusting motor 9, a pivoting of the throttle valve 6 into the position illustrated in dash and dot lines as long as the oil pressure of the internal combustion engine which continues to be present for a short period of time after turning off the ignition, continues to be maintained. If the oil pressure again decreases, then the throttle valve 6 again pivots back into its position illustrated in full line. Since the parts 9, 10, 11, 12 and 13 are all of conventional type, forming no part of the present invention, a detailed description thereof is dispensed with herein. The interconnection of the control system of the present invention with the ignition system is also conventional and is such that the control device 11 cannot be actuated by the pressure switch 13 unless ignition is in the turned-off condition.

The operation of the throttle valve 8 is as follows:

When starting the internal combustion engine (not shown) the exhaust gases are conducted to the installation 1 through the inlet channel 2 and are exhausted into the atmosphere through the exhaust channel 3 since the by-pass line 4 is closed off by the throttle valve 8 which is now in the position illustrated in dash and dot lines. If the installation 1 (catalyst with monolith or bulk material) approaches incompatible, intolerable operating ranges as a result of a rising temperature, then the adjusting motor 9' is actuated by way of the temperature sensor 12' arranged within the area of the installation 1, the control device 11' and the electric line 10', whereby the actuation of adjusting motor 9' effects a pivoting of the throttle valve 8 into the position indicated in double dash and dotted lines. The exhaust gases are now conducted into the atmosphere exclusively by way of the by-pass line 4 whereby a further rise of the temperature of the installation 1 is avoided reliably. The throttle valve 8, after turning off the ignition of the internal combustion engine, is pivoted for a short period of time by the oil pressure switch 13' with the position illustrated in double dash and dotted lines as already described in connection with the oil pressure switch 13, whence a getting stuck due to rusting and corrosion on the part of the throttle valve in the position indicated in dash and dot lines is prevented as a result of a longer non-use by the temperature sensor 12'.

While I have shown and described only two embodiments in accordance with the present invention, it is understood that the same is not limited thereto but is susceptible of numerous changes and modifications as known to those skilled in the art. For example, in lieu of the oil pressure of the internal combustion engine, also any other suitable parameter may be used. Hence, I do not wish to be limited to the details shown and described herein but intend to cover all such changes and modifications as are encompassed by the scope of the appended claims.

I claim:

1. An installation for the catalytic afterburning of exhaust gases in an exhaust gas system of an internal combustion engine, which includes a by-pass line means by-passing the installation for the catalytic afterburning, in which is arranged a throttle valve means actuated in dependence on the temperature of the installation for the catalytic afterburning, further means for actuating the throttle valve also independently of the temperature of the installation for the catalytic afterburning, in dependence of at least one parameter of the internal combustion engine, characterized in that the throttle valve means is actuated, after turning off the ignition of the internal combustion engine, by the oil pressure in the internal combustion engine which continues to exist for a short period of time, by way of an oil pressure switch means and a control means forming part of said further means.

2. An installation according to claim 1, characterized in that the throttle valve means is constituted by a throttle valve opening and closing only the by-pass line.

3. An installation according to claim 1, characterized in that the throttle valve means is constituted by a throttle valve alternately opening and closing the by-pass line means and the inlet channel to the installation for the catalytic afterburning.

4. An installation according to claim 1, characterized in that the throttle valve means includes a throttle valve alternately opening and closing the by-pass line means and the inlet channel to the installation for the catalytic afterburning.

5. An installation, for the catalytic afterburning of exhaust gases in an exhaust gas system of an internal combustion engine, which includes a by-pass line means by-passing the installation for the catalytic afterburning, in which is arranged a throttle valve means actuated in dependence on the temperature of the installation for the catalytic afterburning, further means for actuating the throttle valve also independently of the temperature of the installation for the catalytic afterburning, in dependence of at least one parameter of the internal combustion engine, including an adjusting motor for the throttle valve means which is actuated by a control means, and means responsive to said parameter connected with an input of said control means, characterized in that said control means is an electronic control device, and said means responsive to said parameter is an oil pressure switch responsive to the oil pressure of the engine and effective only upon turning off the engine ignition.

6. An installation according to claim 5, characterized in that a temperature sensor means sensing the temperature of the installation is connected to another input of said control means.

* * * * *